US006183313B1

(12) United States Patent
Kashiyama

(10) Patent No.: US 6,183,313 B1
(45) Date of Patent: Feb. 6, 2001

(54) DOUBLE LOCK CONNECTOR

(75) Inventor: Motohisa Kashiyama, Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/280,697

(22) Filed: Mar. 30, 1999

(30) Foreign Application Priority Data

Apr. 17, 1998 (JP) ..... 10-107913

(51) Int. Cl.[7] ..... H01R 13/436
(52) U.S. Cl. ..... 439/752
(58) Field of Search ..... 439/752, 595

(56) References Cited

U.S. PATENT DOCUMENTS 5,460,550 * 10/1995 Okayasu et al. ..... 439/752
5,609,503 * 3/1997 Tsuji et al. ..... 439/752
5,651,703 * 7/1997 Sasai ..... 439/752
5,738,551 * 4/1998 Matsuoka ..... 439/752
5,800,216 * 9/1998 Okada ..... 439/752
5,820,421 * 10/1998 Makino ..... 439/752
5,865,653 * 2/1999 Okada et al. ..... 439/752

FOREIGN PATENT DOCUMENTS 8-88042 4/1996 (JP) .

* cited by examiner

*Primary Examiner*—Gary F. Paumen
(74) *Attorney, Agent, or Firm*—Armstrong, Westerman, Hattori, McLeland & Naughton

(57) ABSTRACT

A double lock connector capable of locking an electric terminal with double locking mechanisms is provided, which includes: a connector housing with an opening; a rear holder to be inserted into the connector housing from the opening in a direction orthogonal to a direction of insertion of the electric terminal so as to lock finally the electric terminal; and an engaging portion provided on the rear holder and having a tapered engaging plane to slidingly engage an edge of the opening so as to engage the rear holder with the connector housing, wherein the rear holder moves inside the connector housing when the electric terminal is pulled out. Thus, a double lock connector capable of preventing disengagement of the rear holder from the connector housing can be realized.

4 Claims, 9 Drawing Sheets

DOUBLE LOCK CONNECTOR

BACKGROUND OF THE INVENTION

1. Field of the Invention

The present invention generally relates to a double lock connector and more particularly, to a double lock connector having a rear holder to finally lock an electric terminal, wherein the rear holder can surely engage a housing of the connector.

2. Description of the Related Art

FIGS. 14 and 15 show a prior art double lock connector disclosed in Japanese Patent Application Laid-open No. 8-88042 (hereinafter "JP '042").

Referring to FIG. 14, a double lock connector 41 of "JP '042" includes a male connector housing 42 made of synthetic resin, a rear holder 44 made of synthetic resin and connected to the connector housing 42 by means of hinges 43, and a female electric terminal 45 accommodated in a connector housing 42.

The rear holder 44 is provided with an electric terminal locking projection 46 on a front end side thereof to lock the electric terminal 45 and a final engaging projection 47 (FIG. 15) corresponding to the connector housing 42 is also formed on a rear end side of the rear holder 44. Description of a provisionally engaging projection is omitted. As shown in FIG. 15, the connector housing 42 is provided with an opening 48 orthogonally to a terminal inserting direction for receiving the rear holder 44, and an engaging groove 49 corresponding to a final engaging projection 47 is formed at a rear end portion of the opening 48.

With a detached state of the rear holder 44 as shown in FIG. 14, the electric terminal 45 is inserted into the connector housing 42 from the rear. The electric terminal 45 is firstly locked by a resilient locking lance 50 (FIG. 15) of the connector housing 42. Next, the electric terminal 45 is secondly locked by the electric terminal locking projection 46 as shown in FIG. 15 by inserting the rear holder 44 forwardly aslant. In case that the electric terminal 45 has to be released at maintenance work or the like, the final engaging projection 47 is disengaged from the engaging groove 49 by means of forcibly pulling out the rear holder 44 with a jig. In FIG. 15, reference numerals 51 and 52 indicate a mating female connector housing and a mating male electric terminal, respectively.

With respect to the above prior art double lock connector of JP '042, however, there is a drawback that the final engaging projection 47 is apt to be worn or to deform and its engaging strength becomes weak in case the rear holder 44 is iteratively attached and detached, thereby causing easy disengagement of the final engaging projection 47 from the connector housing 42. Also, in case that clearance between the rear holder 44 and the connector housing 42 is large, the final engaging projection 47 is apt to easily disengages from the engaging groove 49 of the connector housing 42. More particularly, in case that an electric wire 53 is strongly pulled, the rear holder 44 is pushed rearward by the electric terminal 45 and is apt to be released from the connector housing 42, thereby causing a lowering of locking strength of the electric terminal 45 and finally causing coming-out of the electric wire 53.

SUMMARY OF THE INVENTION

In view of the foregoing, an object of the present invention is to provide a double lock connector, that is, an engaging structure of a rear holder, wherein iterative attachment and detachment of the rear holder does not cause lowering of engaging strength of the rear holder and more particularly, even in case that clearance between the rear holder and a connector housing is large and the rear holder is pushed rearward by an electric terminal strongly pulled through an electric wire, the rear holder does not disengage from the connector housing.

In order to achieve the above-described object, as a first aspect of the present invention, a double lock connector consists of: a connector housing with an opening; an electric terminal to be inserted into the connector housing; a rear holder to be inserted into the connector housing from the opening in a direction orthogonal to a direction of insertion of the electric terminal so as to lock the electric terminal; and an engaging portion provided on the rear holder and having a tapered engaging plane to slidingly engage an edge of the opening so as to engage the rear holder with the connector housing, wherein the rear holder moves inside the connector housing when force to pull the electric terminal out acts, thereby preventing disengagement of the rear holder from the connector housing.

According to the above-described structure, since the tapered engaging plane of the rear holder abuts on the edge of the opening and the rear holder is lowered inside the connector housing when the electric terminal is pulled rearward, disengagement of the rear holder can be prevented and therefore the electric terminal can be surely locked. And, since the tapered engaging plane of the rear holder slides smoothly on the edge of the opening when the rear holder is detached, even if the rear holder is iteratively attached and detached, wear or deformation of the engaging portion can be prevented, engaging strength of the rear holder can remain unchanged, and locking strength of the electric terminal can also remain unchanged.

As a second aspect of the present invention, in the double lock connector with the above first aspect, the engaging portion is an engaging projection.

According to the above-described structure, since the engaging projection is given a resilience, wear or deformation of the engaging projection can be prevented even better on attachment or detachment of the rear holder.

As a third aspect of the present invention, in the double lock connector with the above first aspect, whole of a rear end portion of the rear holder forms the tapered engaging plane of the engaging portion.

According to the above-described structure, since the engaging portion has high rigidity, deformation of the engaging portion does not occur even if the rear holder is iteratively attached and detached.

And, as a fourth aspect of the present invention, in the double lock connector with the above first aspect, the rear holder has a side plate having a guide slot and the connector housing has a provisionally engaging projection, a guide projection, and a final engaging assisting projection each to engage the guide slot so as to provisionally engage the rear holder with the connector housing, to guide the rear holder, and to assist to finally engage the rear holder with the connector housing.

According to the above-described structure, since the provisionally engaging projection, the guide projection, and the final engaging assisting projection provisionally engages the rear holder with the connector housing, guides the rear holder, and assists to finally engage the rear holder with the connector housing, respectively, the rear holder can be smoothly attached to the connector housing and disengagement of the rear holder can be prevented even better and, therefore, the electric terminal can be locked surer.

The above and other objects and features of the present invention will become more apparent from the following description taken in conjunction with the accompanying drawings.

DESCRIPTION OF THE PREFERRED EMBODIMENTS

Embodiments of the present invention will now be described in further detail with reference to the accompanying drawings.

FIGS. 1 to 11 show a first embodiment of a double lock connector in accordance with the present invention.

Figure 1:
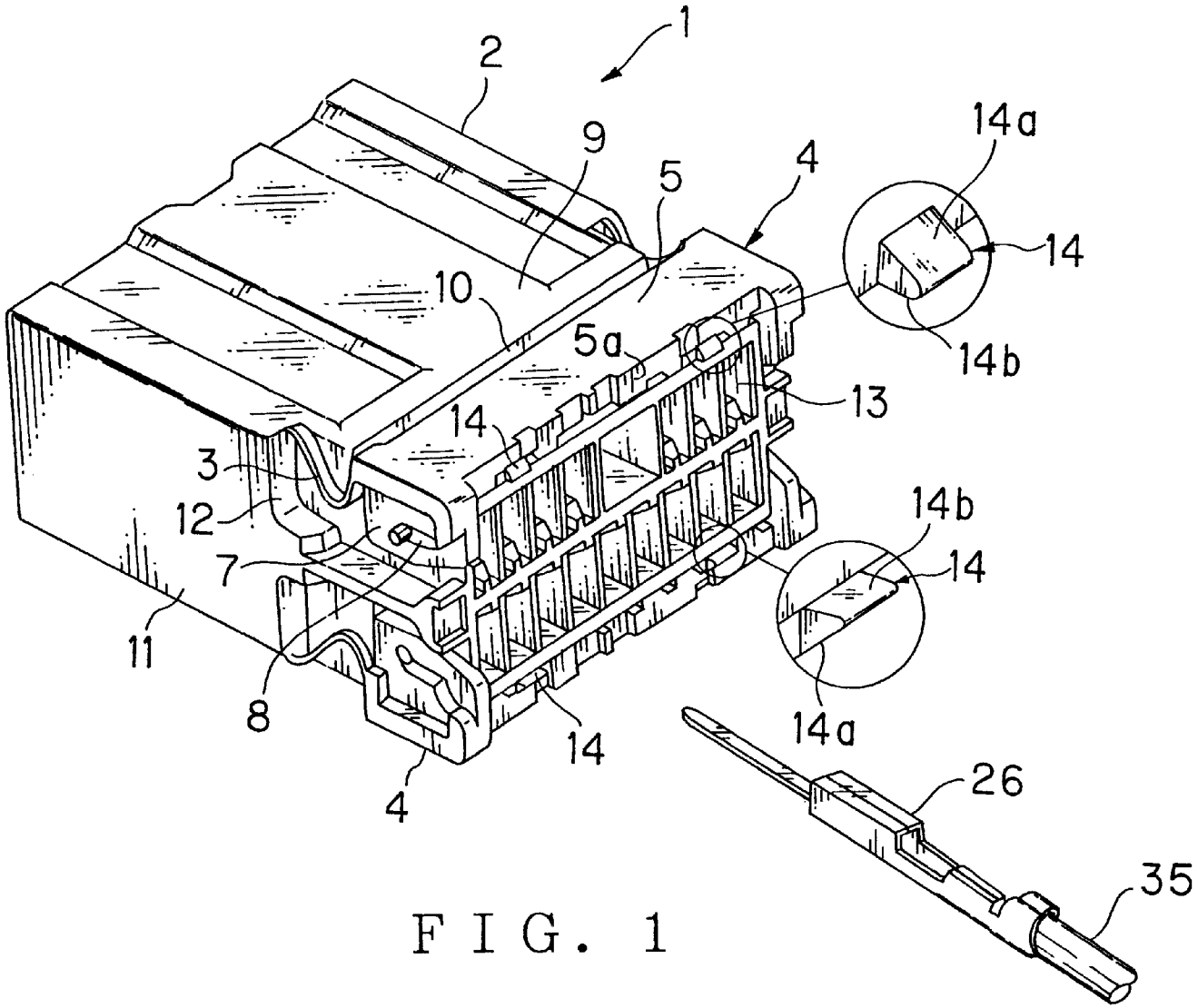
FIG. 1 is an exploded perspective view showing a first embodiment of a double lock connector in accordance with the present invention.

As shown in FIG. 1, a double lock connector 1 includes a female connector housing 2 made of synthetic resin, a rear holder 4 made of synthetic resin and connected to the connector housing 2 by means of resilient thin hinges 3, and a male electric terminal 26 accommodated in a terminal accommodating chamber 13 of the connector housing 2. The rear holder 4 is provided, at the rear end thereof, with a pair, right and left, of final engaging projections (i.e. engaging portions) 14 each having a tapered engaging plane 14*a* corresponding to the connector housing 2.

The rear holder 4 has an electric terminal locking projection 6 (FIG. 3) forwardly projecting from an inside of a main plate portion 5 and guide slots 8 in a S-like shape which are formed on respective side plates 7 vertically provided on both sides of the main plate portion 5.

In the present embodiment, the rear holder 4 is provided on respective upper and lower rear portions of the connector housing 2. An opening 10 for receiving the rear holder 4 is notched on respective upper and lower walls 9 of the connector housing 2. A receiving portion 12 corresponding to the side plate 7 of the rear holder 4 is provided on side walls 11 of the connector housing 2. The side plate 7 is thin and is capable of bending outwardly. The side plates 7 are located outside the opening 10, that is, in the respective receiving portions 12. The hinges 3 are provided from the respective front ends of the receiving portions 12, on the respective upper and lower walls 9, to the respective front ends of the rear holder 4, after bending in the receiving portions 12.

The electric terminal locking projection 6 (FIG. 3) of the rear holder 4 is formed in a comb-like shape corresponding to a plurality of terminal accommodating chamber 13 of the connector housing 2. The main plate portion 5 is provided, on a rear end surface 5*a* thereof, with a final engaging projection 14 having a triangle section to engage a rear edge 10*a* (FIG. 4) of the opening 10. The rear holder 4 has two final engaging projections 14 each continuing a rear end side of the electric terminal locking projection 6, projecting rearward from the rear end surface 5*a* of the main plate portion 5, and being located near an inside surface 5*b* (FIG. 4) of the main plate portion 5.

Figure 2:
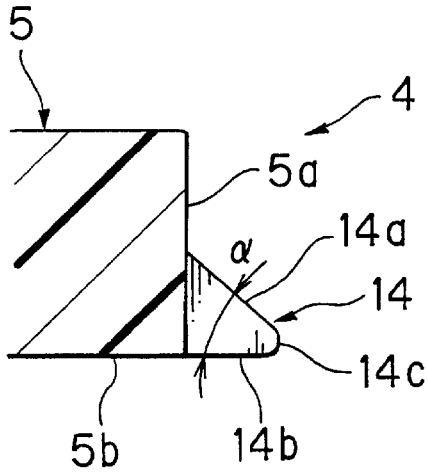
FIG. 2 is a longitudinal sectional view showing a final engaging projection of a rear holder.

That is, a horizontal plane 14*b* of the final engaging projection 14 is on the same plane as the inside surface 5*b* (FIG. 2) of the main plate portion 5, and the tapered engaging plane 14*a* of the final engaging projection 14 is put into contact with the rear edge 10*a* (FIG. 4) of the opening 10 of the connector housing 2 and faces outside of the main plate portion 5, i.e. faces in a detaching direction of the rear holder 4. As shown in FIG. 2, the tapered engaging plane 14*a* continues from the rear end surface 5*a* of the main plate portion 5. A tip 14*c* of the final engaging projection 14 is rounded. The tapered engaging plane 14*a* has a preferable sloping angle $\alpha$ of 30° to 45°.

As described hereinafter, the tapered engaging plane 14*a* acts as a sliding surface corresponding to the rear edge 10*a* (FIG. 4) of the opening 10 of the connector housing 2 and therefore, a large loping angle $\alpha$ causes poor slidability and weak final engaging strength. A pair, right and left, of final engaging projections 14 shown in FIG. 1 make the rear holder 4 with a large width engage the connector housing 2 stable. FIG. 1 shows a provisionally engaged state of the rear holder 4.

Figure 3:
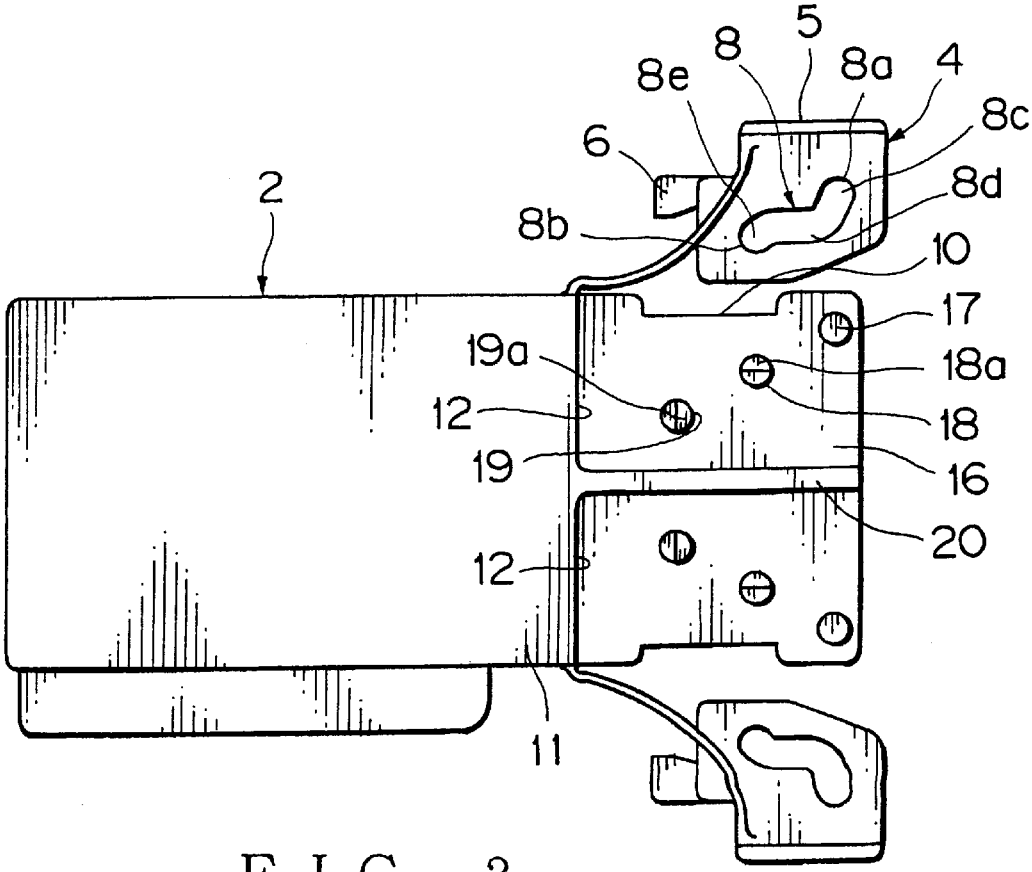
FIG. 3 is a side view showing a detached state of the rear holder from a connector housing.

FIG. 3 shows a completely detached state of the rear holder 4. A wall section 16 of the receiving portion 12 of the side wall 11 of the connector housing 2 is provided with a provisionally engaging projection 17, a guide projection 18, and a final engaging assisting projection 19 all corresponding to the rear holder 4 and being aligned in a slanting line directed to the center of the connector housing 2.

The provisionally engaging projection 17 and the final engaging assisting projection 19 have a height smaller than a depth of the guide slot 8, and the guide projection 18, positioned in the middle, has a height approximately twice the other projections 17,19, that is, has almost the same height as the depth of the guide slot 8, and projects cylindrically. The guide projection 18 and the final engaging assisting projection 19 have respective guide tapered-planes 18*a*,19*a* at the ends thereof.

As shown in FIG. 3, length of the guide slot 8 and intervals of the projections 17 to 19 are decided so that any one of adjoining pairs of the projections, i.e. 17 and 18, and 18 and 19, of the three projections 17 to 19 is capable of engaging both of a front end portion 8*b* and a rear end portion 8*a* of the guide slot 8 of the rear holder 4.

The guide slot 8 continues from the rear end portion 8*a* near the main plate portion 5, through a long inclined portion 8*c* with steep grades, a horizontally long straight portion 8*d*, and a short inclined portion 8*e* with gentle grades, to the front end portion 8*b*. Referring to FIG. 3, a reference numeral 20 indicates a partition provided between the upper and lower receiving portions 12.

Figure 4:
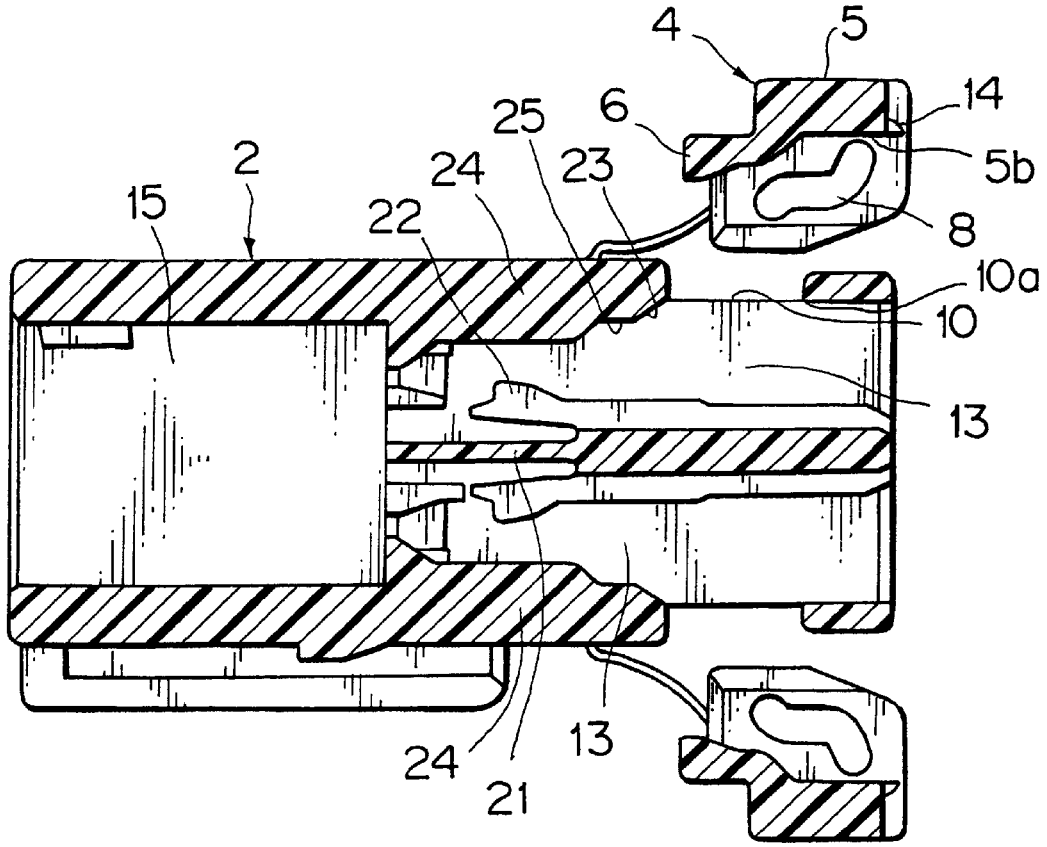
FIG. 4 is a longitudinal sectional view showing the detached state of the rear holder from the connector housing.

FIG. 4 shows a longitudinal sectional view of the connector housing 2 and the rear holder 4. Resilient locking lances 22 are provided on the wall portion 21 dividing the upper and lower terminal accommodating chambers 13 which continue to a connector coupling chamber 1. The opening 10 communicates with the rear half of the terminal accommodating chamber 13, and the electric terminal locking projection 6 of the rear holder 4 is capable of proceeding in the terminal accommodating chamber 13. The electric terminal locking projection 6 is located lower than the main plate portion 5 by one step.

A tapered guide plane 23 corresponding to the electric terminal locking projection 6 and facing the terminal accommodating chamber 13 is formed at the front end of the opening 10, and an approaching portion 25 also corresponding to the electric terminal locking projection 6 is formed on the upper (or lower) wall 9 of the connector housing 2, continuing from the tapered guide plane 23.

Figure 5:
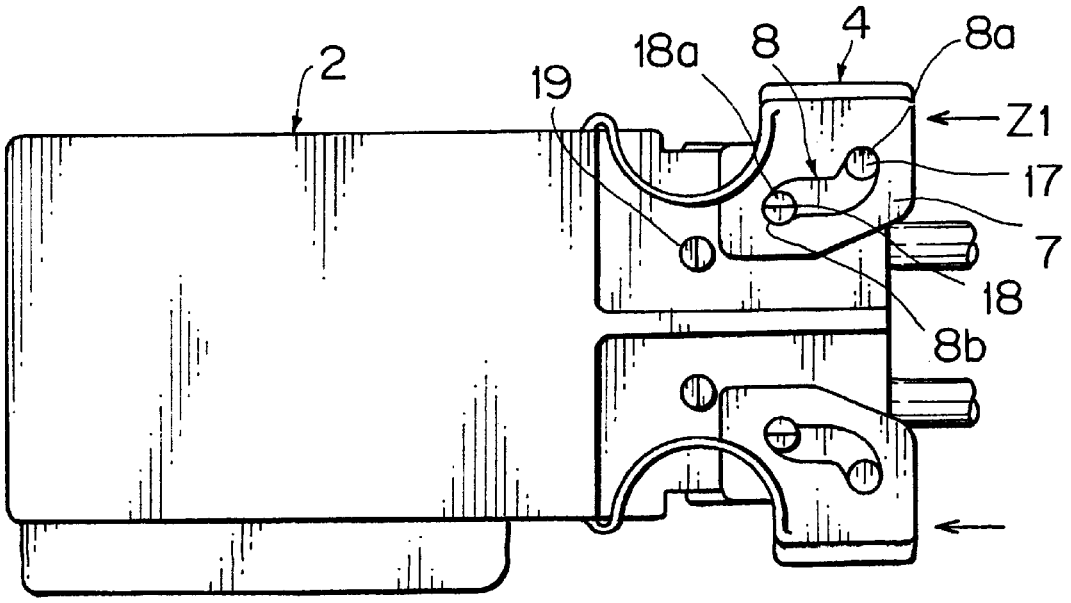
FIG. 5 is a side view showing a provisionally engaged state of the rear holder with the connector housing.
Figure 6:
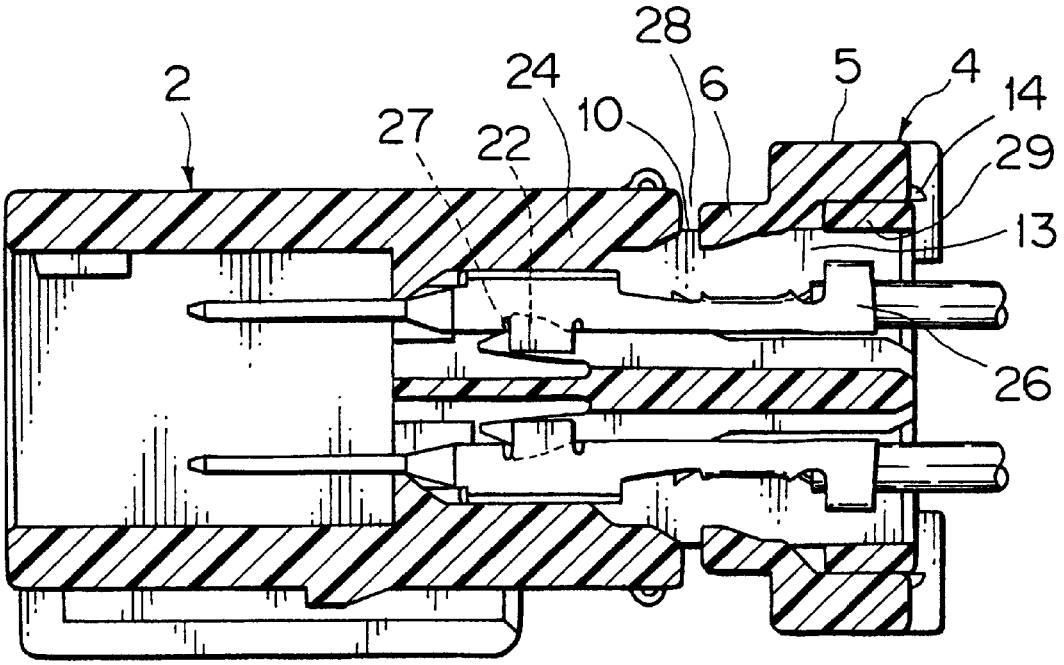
FIG. 6 is a longitudinal sectional view showing the provisionally engaged state of the rear holder and an inserted state of an electric terminal.

FIGS. 5 and 6 show a provisionally engaged state of the rear holder 4 to the connector housing 2. As is shown in FIG. 5, the rear end portion 8*a* of the guide slot 8 engages the provisionally engaging projection 17 and the guide slot 8 of the front end portion 8*b* engages the guide projection 18. The final engaging assisting projection 19 is positioned just in front of the front end of the side plate 7 of the rear holder 4.

On making the guide slot 8 engages the projections 17,18, the side plate 7 bends outwardly along a tapered guide plane 18*a* of the guide projection 18 thereby to smoothly engage the guide slot 8 to the projections 17,18. Since the provisionally engaging projection 17 is lower than the guide projection 18, the engagement is smoothly executed without a tapered guide plane on the provisionally engaging projection 17.

As shown in FIG. 6, at the provisionally engaged state of the rear holder 4, an electric terminal 26 is inserted into the terminal accommodating chamber 13 from the rear. A projection of the resilient locking lance 22 engages an engaging step 27 of the electric terminal 26. The electric terminal locking projection 6 of the rear holder 4 is located in the opening 10. Between the front end of the electric terminal locking projection 6 and the front end of the opening 10, a clearance 28 exists. The main plate portion 5 of the rear holder 4 is located on a thin wall portion 29 behind the opening 10. The wall portion 29 is a part of the upper (or lower) wall 9.

From the provisionally engaged state of the rear holder 4 shown in FIG. 5, the rear holder 4 is given turning force with the guide projection 18 as a fulcrum when the rear end of the main plate portion 5 is forwardly pushed in an arrow Z1 direction.

Figure 7:
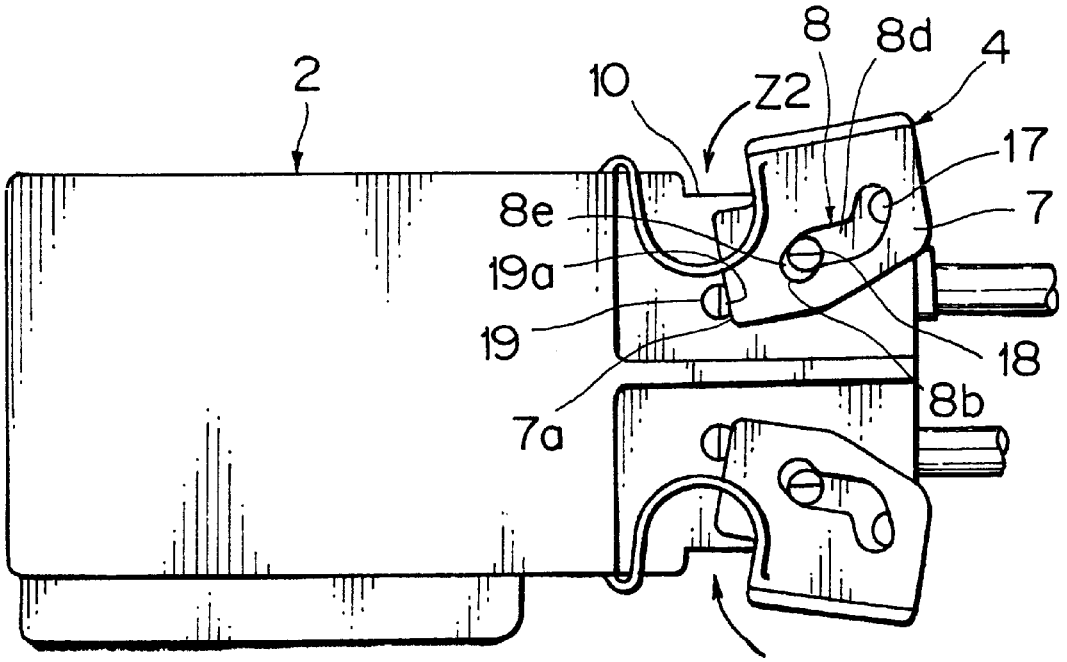
FIG. 7 is a side view showing an attaching state of the rear holder to the connector housing.
Figure 8:
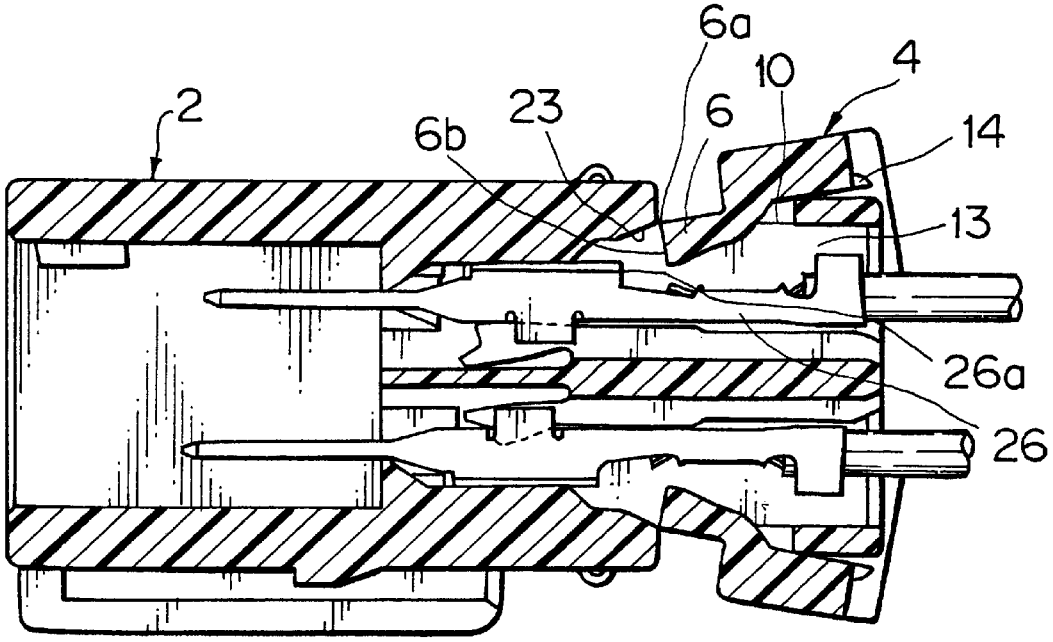
FIG. 8 is a longitudinal sectional view showing the attaching state of the rear holder to the connector housing.

As shown in FIGS. 7 and 8, the rear holder 4 enters the opening 10 of the connector housing 2 with turning movement in an arrow Z2 direction. In FIG. 7, the provisionally engaging projection 17 is released from the guide slot 8, while the side plate 7 bends outwardly, and the guide projection 18 leaves the short inclined portion 8*e* or the front end portion 8*b* of the guide slot 8 and proceeds into the straight portion 8*d*. Simultaneously, a front end 7*a* of the side plate 7 of the rear holder 4 is put into contact with the final engaging assisting projection 19, and the turning movement of the rear holder 4 is promoted with the final engaging assisting projection 19 as a fulcrum.

As shown in FIG. 8, the electric terminal locking projection 6 of the rear holder 4 enters the terminal accommodating chamber 13 from the opening 10 of the connector housing 2 by turning, and an outside corner 6*a* at the front end of the electric terminal locking projection 6 is put into contact with a front portion of the tapered guide plane 23 ahead of the opening 10.

Referring to FIG. 7, with a pushing operation of the rear holder 4, the straight portion 8*d* of the guide slot 8 moves aslant by being guided by the guide projection 18, and simultaneously, as shown in FIG. 8, the outside corner 6*a* of the electric terminal locking projection 6 slides aslant along the tapered guide plane 23, whereby an engaging portion 6*b* of the electric terminal locking projection 6 is directed to a rear step (shoulder portion) 26*a* of the electric terminal 26.

Figure 9:
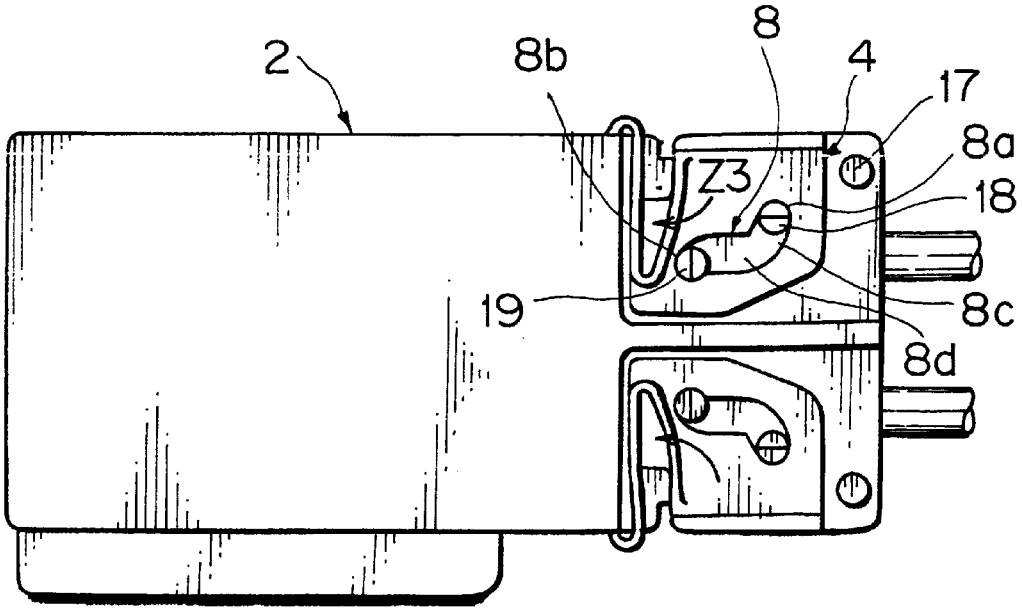
FIG. 9 is a side view showing a finally engaged state of the rear holder with the connector housing.

Referring also to FIG. 7, the final engaging assisting projection 19 proceeds under the side plate 7 of the rear holder 4 by bending the side plate 7 by means of the tapered guide plane 19*a* and finally engages the guide slot 8 as shown in FIG. 9. With the pushing operation of the rear holder 4, the guide projection 18 proceeds from the straight portion 8*d* of the guide slot 8 to the long inclined portion 8*c*, and the rear holder 4 turns in a terminal inserting direction, i.e. in an arrow Z3 direction which reverses the arrow Z2 direction in FIG. 7, and engages the opening 10 completely.

Figure 10:
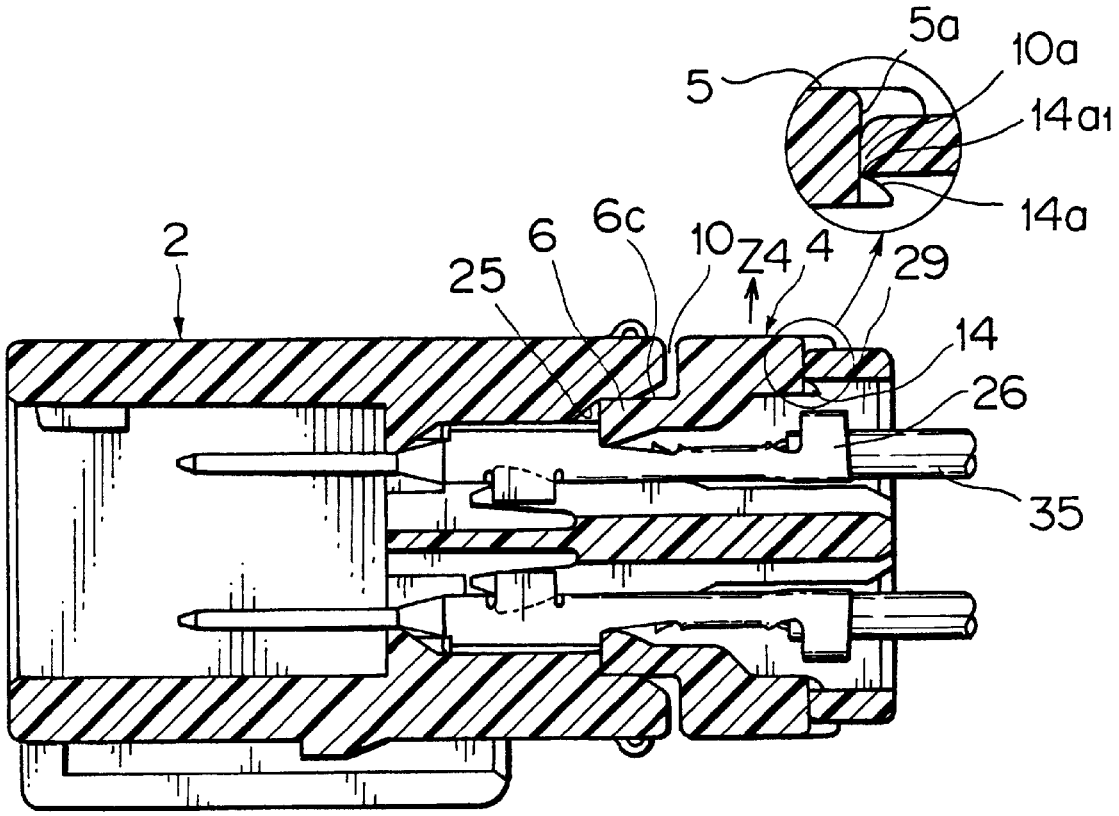
FIG. 10 is a longitudinal sectional view showing the finally engaged state of the rear holder with the connector housing.

FIGS. 9 and 10 show a finally engaged state of the rear holder 4. As shown in FIG. 9, the final engaging assisting projection 19 engages the front end portion 8*b* of the guide slot 8 and the guide projection 18 engages the rear end portion 8*a* of the guide slot 8. The provisionally engaging projection 17 disengages from the guide slot 8.

As shown in FIG. 10, the final engaging projection 14 of the rear holder 4 bends and enters the opening 10, and a base 14*a*1 of the tapered engaging plane 14*a*, more specifically, an intersecting portion between the tapered engaging plane 14*a* and a rear end surface 5*a* of the main plate portion 5, abuts against a rear edge 10*a* of the opening 10, i.e. against a corner of an inside plane of the wall portion 29. An outside plane 6*c* of the electric terminal locking projection 6 is in contact with a wall surface of the approaching portion 25. With this state, the rear holder 4 is surely held in the opening 10.

Figure 11:
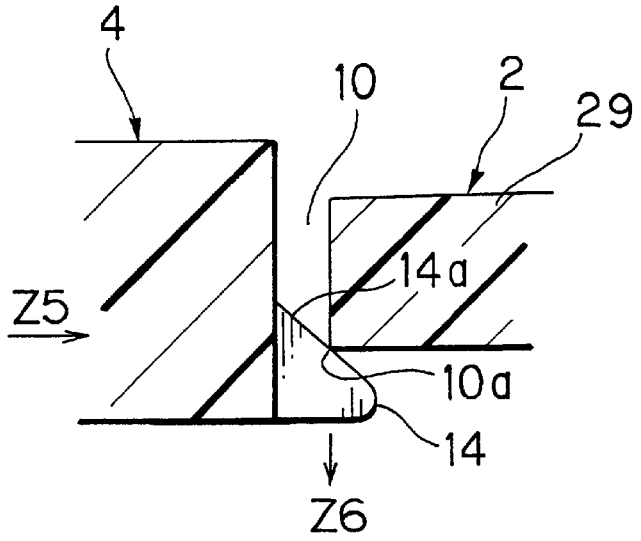
FIG. 11 is a longitudinal sectional view showing an action of the final engaging projection shown in FIG. 2.

In the present invention, as is shown in FIG. 11, since the tapered engaging plane 14*a* of the final engaging projection 14 abuts on the rear edge (a corner) 10*a* of the opening 10, when the electric wire 35 (FIG. 10) is pulled rearward, force directed rearward, i.e. in an arrow Z5 direction in FIG. 11, acts on the rear holder 4, the rear holder 4 is lowered inside the connector housing 2 as shown with an arrow Z6.

Accordingly, as shown in FIG. 10, the electric terminal locking projection 6 surely engages the rear step 26*a* of the electric terminal 26 with a large abutting area, and locking strength for the electric terminal 26 is ensured. And, this action is also the case where the electric terminal 26 is pushed in its detaching direction on coupling of the connector 1 with a mating connector.

And, on detachment of the rear holder 4, since the tapered engaging plane 14*a* of the final engaging projection 14 slides smoothly on the rear edge 10*a* of the opening 10, wear or deformation of the final engaging projection 14 can be prevented.

In case that the sloping angle α (FIG. 2) of the tapered engaging plane 14*a* is set between 30° and 45°, an abutting force of the tapered engaging plane 14*a* against the rear edge 10*a* is large and therefore locking strength of the rear holder 4 is ensured, and simultaneously slide between the tapered engaging plane 14*a* and the rear edge 10*a*, when the electric wire 35 is pulled, can be done surely and smoothly. Further, in this case, since the final engaging projection 14 becomes thin and therefore the final engaging projection 14 is given a resilience, then wear, deformation or the like of the rear holder 4 can be prevented even better on attachment or detachment of the rear holder 4. The sloping angle larger than 45° is in practical use.

Figure 12:
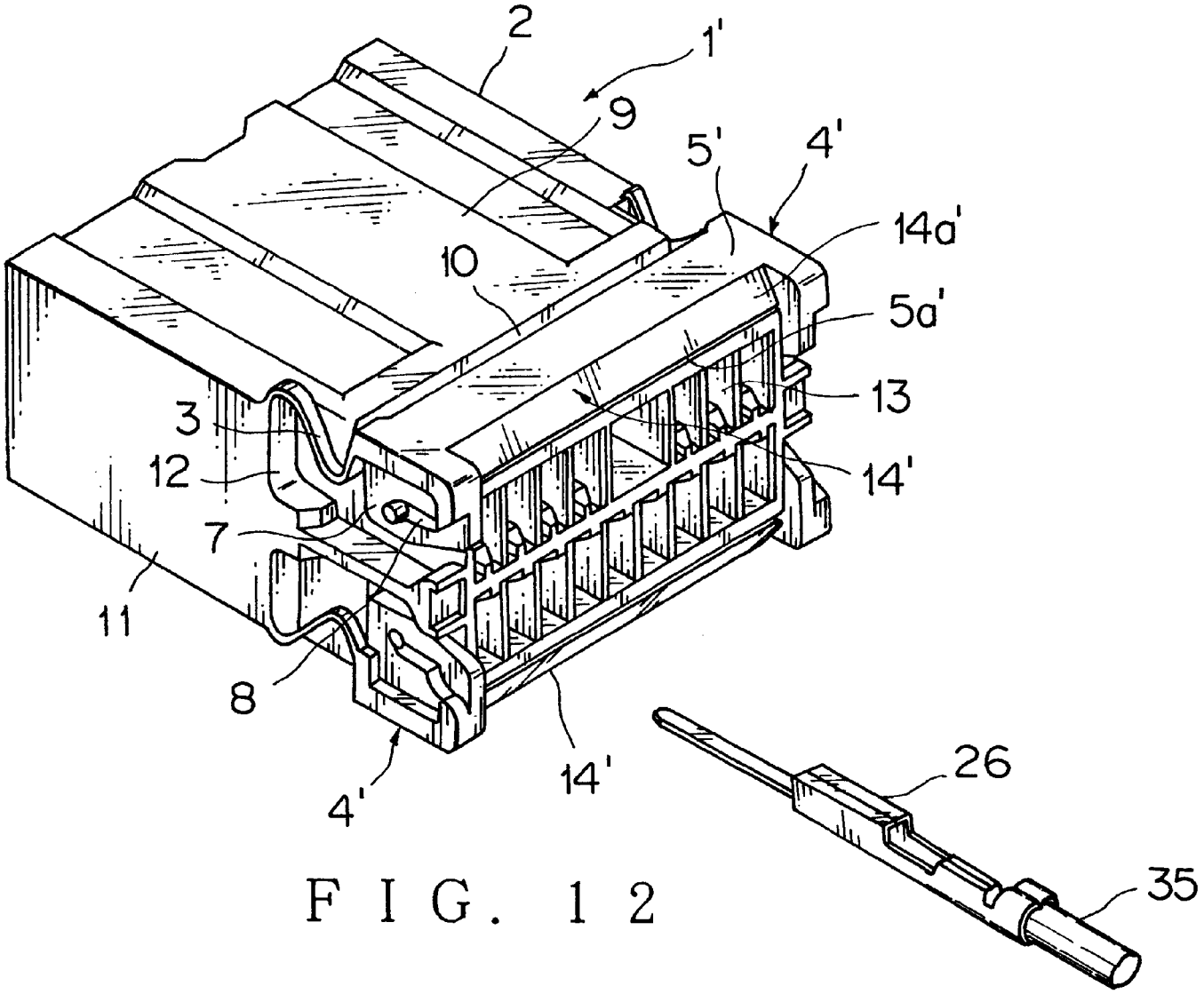
FIG. 12 is an exploded perspective view showing a second embodiment of a double lock connector in accordance with the present invention.
Figure 13:
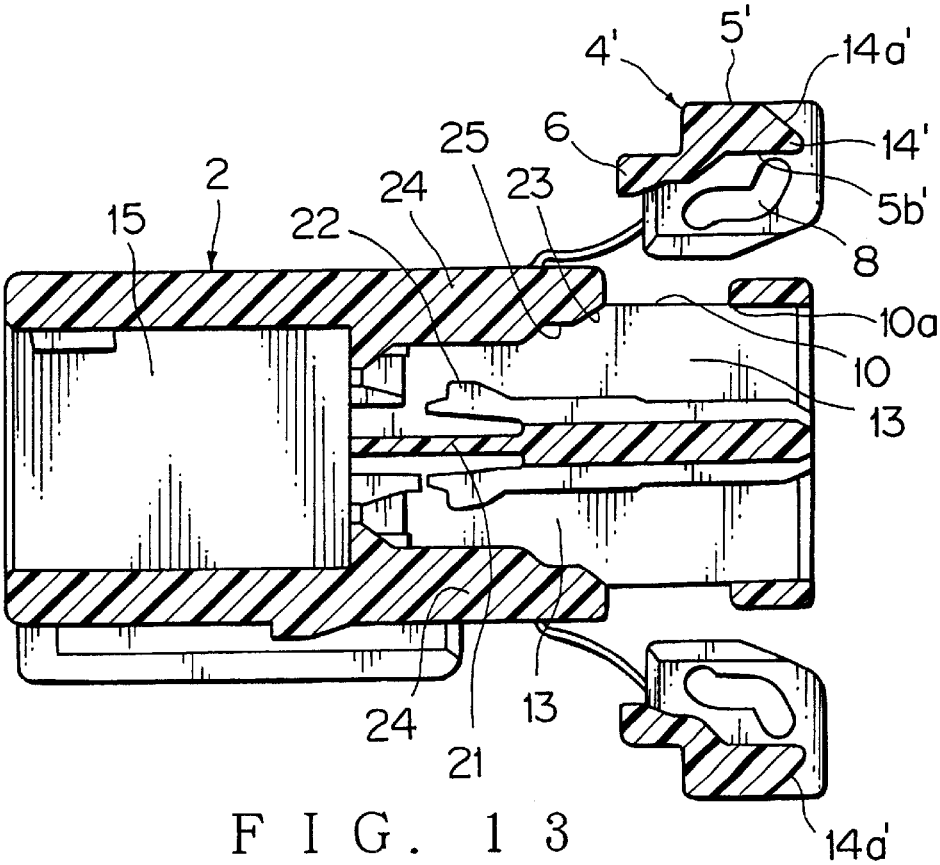
FIG. 13 is a longitudinal sectional view showing the double lock connector of FIG. 12.

FIGS. 12 and 13 show a second embodiment of a double lock connector in accordance with the present invention.

According to the second embodiment, a double lock connector 1' has a rear holder 4' with a tapered engaging plane 14*a*', wherein a rear end portion of a main plate portion 5' is formed as the tapered engaging plane 14*a'*.

That is, the tapered engaging plane 14*a*' occupies whole of the rear end portion, between side plates 7 provided on both sides of the rear holder 4', of the main plate portion 5'. The rear end portion of the main plate portion 5' having the tapered engaging plane 14*a*' acts as the final engaging portion 14'.

In the present embodiment, since the other structure than the engaging portion 14' is basically the same as the first embodiment, the same reference characters are allotted to and related description will be omitted hereinafter.

Referring to FIG. 12, a reference numeral 5*a*' indicates a thin rear end surface continuing to the tapered engaging plane 14*a*', and in FIG. 13 a reference numeral 5*b*' indicates an inside surface of the main plate portion 5'. The tapered engaging plane 14*a*' faces outside of the main plate portion 5', i.e. faces in the detaching direction of the rear holder 4' similarly to the first embodiment.

Referring to FIG. 13, the tapered engaging plane 14*a*' abuts on a rear edge 10*a* of an opening 10 and the rear holder 4' is finally engaged by attaching the rear holder 4' to a connector housing 2 from the opening 10.

Similarly to FIGS. 10 and 11 of the first embodiment, in case that an electric terminal 26 is outwardly pulled and the rear holder 4' moves in a detaching direction in the opening 10, the tapered engaging plane 14*a*' is slidingly put into contact with the rear edge 10*a* of the opening 10 and accordingly receives a force directed to the inside of the connector housing 2, thereby preventing coming-off of the rear holder 4'.

Other final engaging portion (not shown) such as a final engaging projection than the tapered engaging plane 14*a*' may provided.

Also, the guide projection 18 and the final engaging assisting projection 19 shown in FIG. 9 may constitute a final engaging portion.

Figure 14:
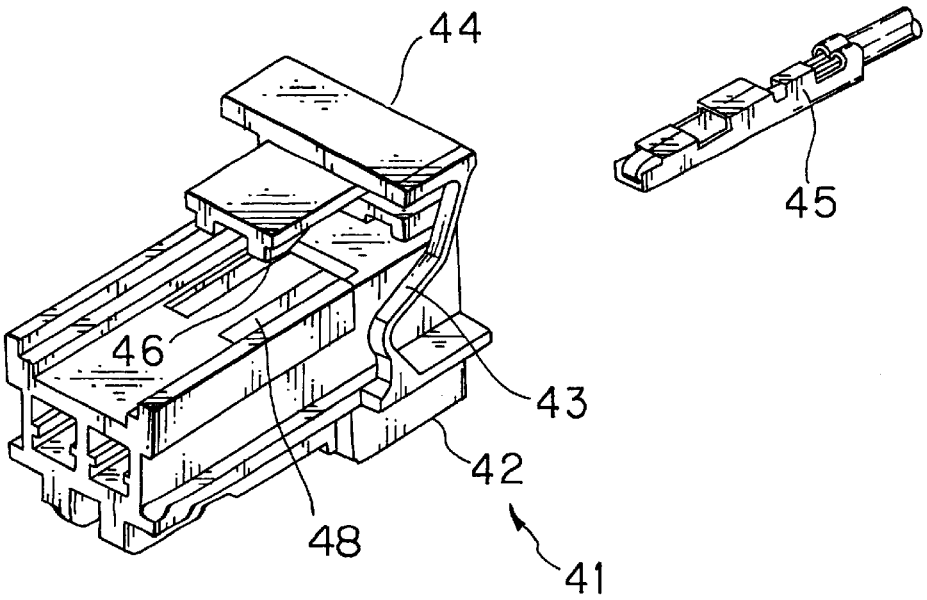
PRIOR ART F I G. 1 4
FIG. 14 is an exploded perspective view showing a prior art double lock connector.
Figure 15:
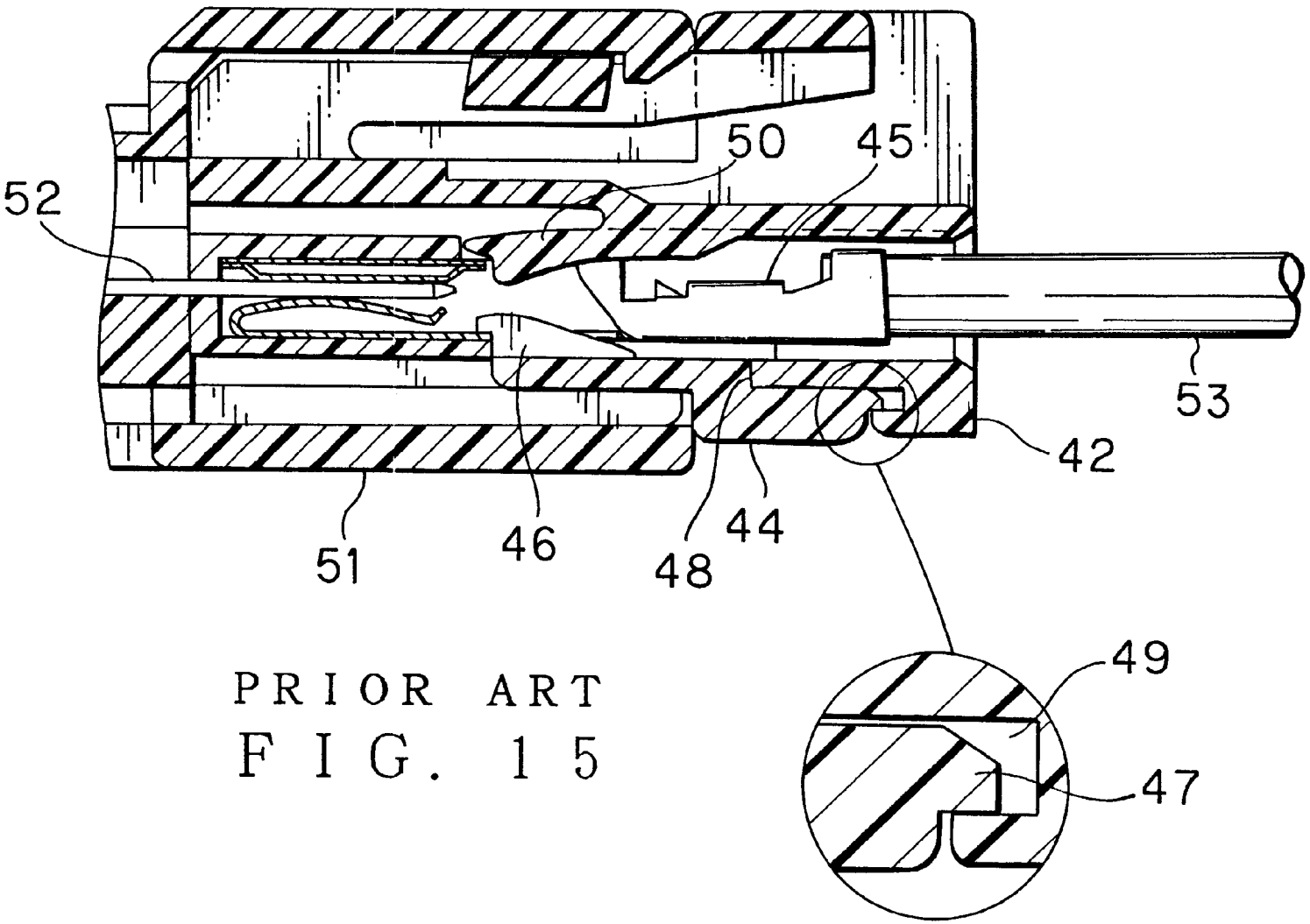
PRIOR ART FIG. 15
FIG. 15 is a longitudinal sectional view showing an assembled state of the prior art double lock connector of FIG. 14.

Further, the tapered engaging planes 14*a* and 14*a*' in the above embodiments are applicable to other connectors such as the double lock connector of the prior art shown in FIG. 14, and the like.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A double lock connector, comprising:

a connector housing having an opening;

an electric terminal insertable into said connector housing;

a rear holder insertable into said connector housing through said opening, in a direction orthogonal to a direction of insertion of said electric terminal, so as to lock said electric terminal; and an engaging projection provided on said rear holder and having a tapered engaging plane being in engagement with an edge of said opening so as to engage said rear holder with said connector housing, wherein said tapered engaging plane is formed on an outside surface of said engaging projection and tapered inwardly with respect to an opposite direction of insertion of said electric terminal so that said rear holder moves along said tapered engaging plane toward the inside of said connector housing when force is applied to pull out said electric terminal, thereby preventing disengagement of said rear holder from said connector housing.

2. The double lock connector according to claim 1, wherein a whole rear end portion of said rear holder forms said tapered engaging plane of said engaging projection.

3. The double lock connector according to claim 1, wherein said rear holder has a side plate having a guide slot, and said connector housing has a provisionally engaging projection, a guide projection, and a final engaging assisting projection, each of said projections being in engagement with said guide slot so as to provisionally engage said rear holder with said connector housing, to guide said rear holder, and to assist in finally engaging said rear holder with said connector housing.

4. The double lock connector according to claim 2, wherein said rear holder has a side plate having a guide slot, and said connector housing has a provisionally engaging projection, a guide projection, and a final engaging assisting projection, each of said projections begin in engagement with said guide slot so as to provisionally engage said rear holder with said connector housing, to guide said rear holder, and to assist in finally engaging said rear holder with said connector housing.

* * * * *